United States Patent [19]

Johnson

[11] 4,239,143

[45] Dec. 16, 1980

[54] DRIVER ASSEMBLY FOR SMALL-DIAMETER FASTENERS

[75] Inventor: Peter W. Johnson, Toronto, Canada

[73] Assignee: Olin Corporation, New Haven, Conn.

[21] Appl. No.: 41,027

[22] Filed: May 21, 1979

[51] Int. Cl.[3] ..... B25C 1/14; B25C 1/18

[52] U.S. Cl. ..... 227/10; 227/149; 173/133; 173/139

[58] Field of Search ..... 60/631, 632, 633, 634, 60/635, 636, 637; 173/133, 139; 227/10, 149, 11

[56] References Cited

U.S. PATENT DOCUMENTS

| | | | |
|---|---|---|---|
| 3,058,116 | 10/1962 | Hilti | 227/10 |
| 3,066,302 | 12/1962 | De Caro et al. | 227/11 X |
| 3,095,593 | 7/1963 | Siddons | 227/10 |
| 3,494,431 | 2/1970 | Yoho et al. | 173/133 X |
| 3,503,549 | 3/1970 | Brunelle | 227/149 |
| 3,827,678 | 8/1974 | Oesterele et al. | 227/11 |
| 3,866,692 | 2/1975 | Stelljes | 173/133 X |

*Primary Examiner*—Paul A. Bell

*Attorney, Agent, or Firm*—William W. Jones; Paul J. Lerner

[57] ABSTRACT

A driver assembly for reliably driving relatively small-diameter washered and nonwashered fasteners from an indirect-acting powder-actuated tool comprises an adapter, carried on the muzzle end of the tool barrel and having a bore wherein is operatively disposed an adapter piston adapted for cooperation with the tool piston. The adapter bore comprises two portions: a first portion, of a size to slidingly admit the shank of the tool piston, and a second portion, having a diameter of a size to guide and support the fastener during driving thereof. The adapter piston includes a head slidingly fitted in the first adapter bore portion and a shank so fitted in the second bore portion. The adapter piston is preferably spaced apart from the tool piston when both are in the driving position, whereby tool recoil is reduced.

9 Claims, 3 Drawing Figures

DRIVER ASSEMBLY FOR SMALL-DIAMETER FASTENERS

BACKGROUND AND SUMMARY OF THE INVENTION

The present invention relates to powder-actuated tools and, more particularly, to an improvement or attachment permitting the successful driving of relatively small-diameter washered and nonwashered fasteners from an indirect-acting tool.

Indirect-acting, powder-actuated tools adapted for driving fasteners into hard receiving materials, such as metal, masonry, concrete and the like, are well known in the art. One such tool is disclosed in U.S. Pat. No. 3,066,302. Tools of this type, while effective, suffer from a lack of versatility in that use with small-diameter fasteners, i.e. fasteners having a shank diameter appreciably smaller than the diameter of the barrel bore of the tool, requires the attachment of one or more bore-sized washers to the fastener for centering and guidance thereof during driving. Use of such washers is sometimes undesirable, however, as they may be retained on the fastener after driving, rendering impossible the flush-mounting of an item against the surface to which it is attached. Further, the use of such washers leaves the bulk of the fastener shank unsupported during the driving process. Such small, unsupported fastener shanks are subject to bending or buckling during insertion into hard receiving materials, whereby reliable installation of such fasteners may be difficult to achieve.

It is, therefore, a primary object of the present invention to provide means whereby relatively small-diameter fasteners may be reliably driven by existing indirect-acting powder-actuated tools.

It is a further object to provide means whereby such fasteners may be driven by such tools without the addition of washers or other such guiding members and with minimal recoil.

The above and other objects as may hereinafter appear are achieved by an adapter, carried on the muzzle end of the tool barrel and having a bore wherein is operatively disposed an adapter piston adapted for cooperation with the tool piston, the adapter being provided with means for retaining a fastener therein prior to driving thereof. More specifically, the adapter bore comprises two portions: a first portion, of a size to slidingly admit the shank of the tool piston, and a second portion, having a diameter of a size to guide and support the fastener during driving thereof. The adapter piston includes a head slidingly fitted in the first portion of the adapter bore and a shank so fitted in the second bore portion. The adapter piston is preferably spaced apart from to tool piston when both are in the driving or ready-to-fire position, whereby tool recoil is reduced.

DESCRIPTION OF THE PREFERRED EMBODIMENT

The present invention comprises a muzzle adapter 1, an adapter piston 3 operatively disposed in the muzzle adapter 1, retention means 5 on the muzzle adapter 1 for retaining a fastener therein prior to driving thereof, and a shroud 9 surrounding the muzzle adapter 1 and limiting access thereto.

Figure 1:
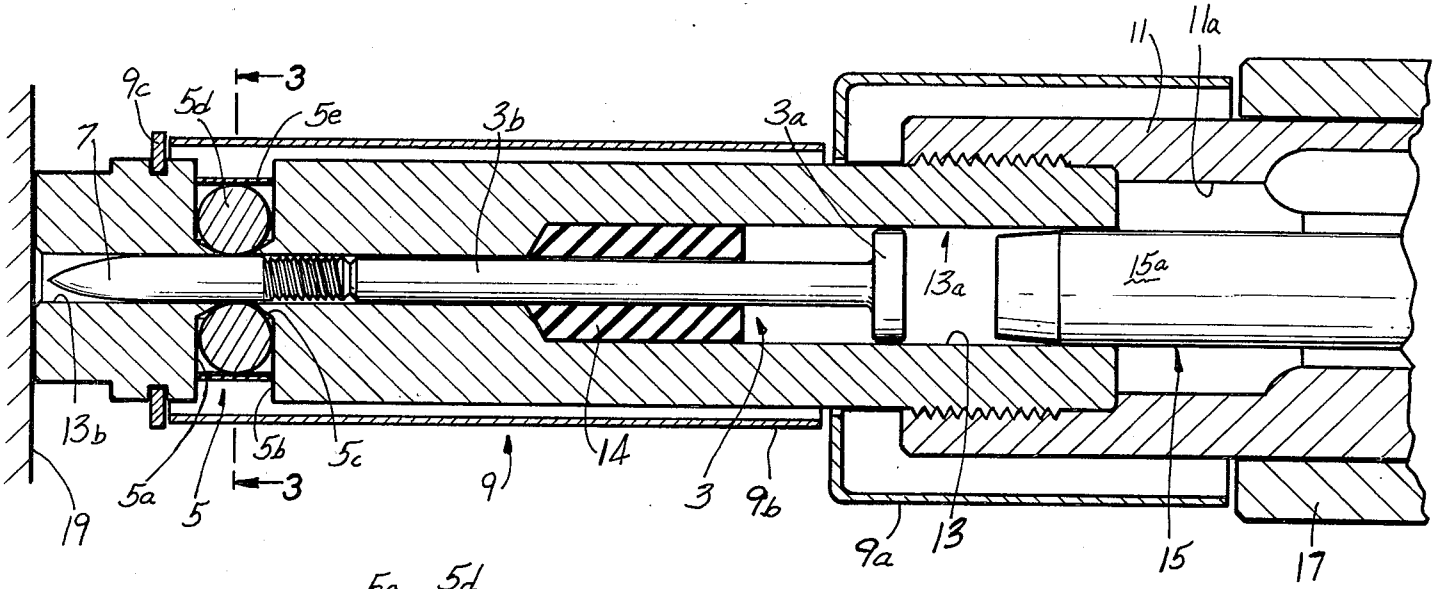
FIG. 1 is a fragmentary cross-sectional view of an embodiment of the present invention in association with a powder-actuated tool, said tool being in a cocked condition.
Figure 3:
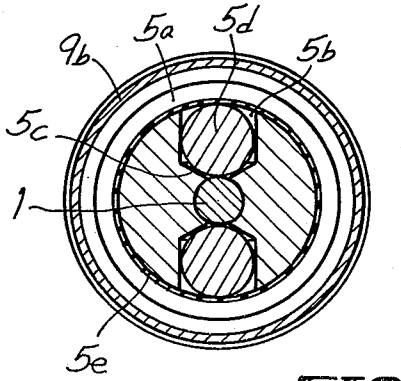
FIG. 3 is a cross-sectional view taken along line 3—3 of FIG. 1.
Figure 2:
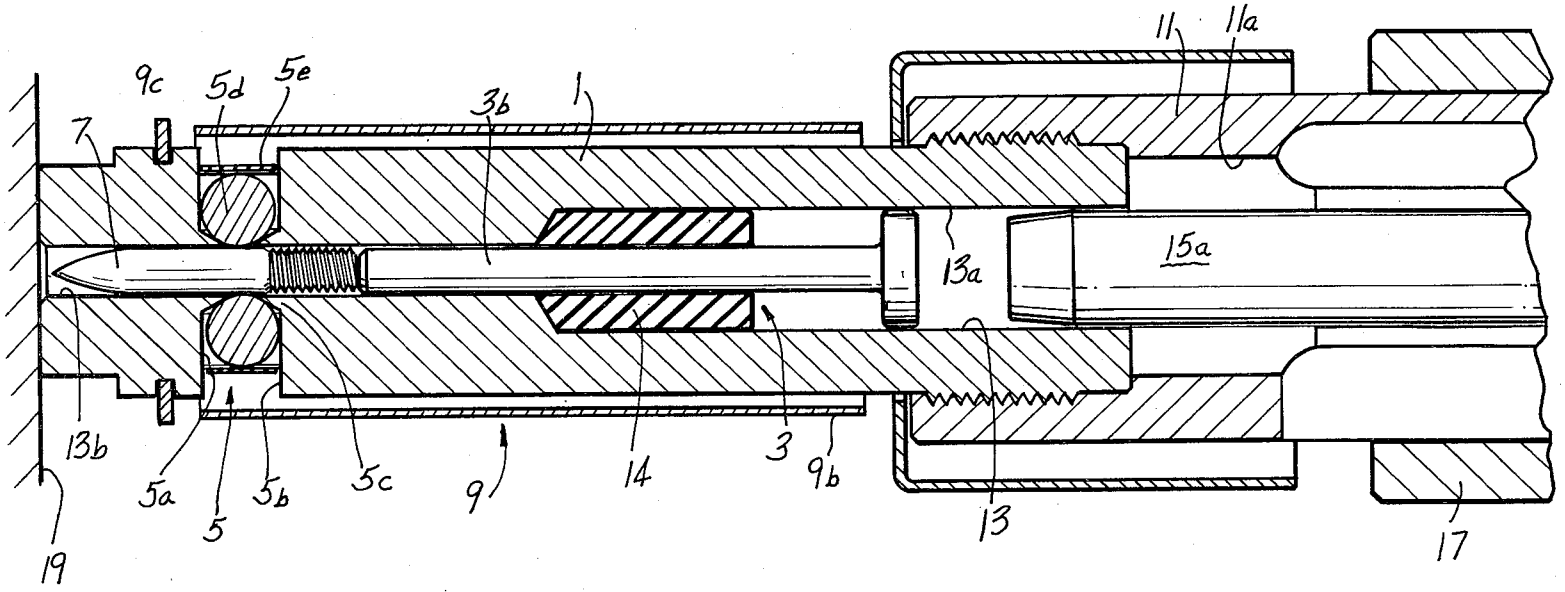
FIG. 2 is a fragmentary cross-sectional view of the tool of FIG. 1 in an uncocked condition.

In FIG. 1, the adapter 1 is seen attached to the barrel 11 of a powder-actuated tool constructed in accord with the teachings of the previously mentioned U.S. Pat. No. 3,066,302, replacing therein the abutment sleeve.

The muzzle adapter 1 is a substantially tubular member having an axial through-bore 13, concentric with the bore 11*a* of the tool barrel 11, and comprising two portions: a first portion 13*a*, adjacent the tool barrel 11, of a size to slidingly admit the shank 15*a* of the tool piston 15, and a second portion 13*b*, in the distal end of the adapter 1, of a size to slidingly admit a fastener 7 to be driven. It is to be noted that the second portion 13*b* of the muzzle adapter bore 13 is of substantially smaller diameter than the first portion 13*b* thereof.

The adapter piston 3 comprises a piston head 3*a*, of a size to slidingly fit within the first portion 13*a* of the muzzle adapter bore 13, i.e. of the same diameter as the shank 15*a* of the tool piston 15, and a piston shank 3*b*, of a size to slidingly fit within the second bore portion 13*b*. The adapter piston 3 is most advantageously of such length that it is spaced apart approximately $\frac{1}{4}$ of an inch from the tool piston 15 when both are in the firing position as shown in FIG. 1, such a spacing serving to minimize tool recoil. Separation in excess of this distance has been found to result in thread damage to the fastener being driven, while decreasing piston separation below this distance has been found to result in increasing tool recoil.

A tubular, resilient buffer 14 is disposed in the first portion 13*a* of the muzzle adapter bore 13, adjacent the second portion 13*b* thereof, with the adapter piston shank 3*b* passing through a central through-bore therein.

The retention means 5 comprises a pair of diametrically opposed cylindrical recesses 5*a* formed in the base of an annular groove 5*b*, located near the muzzle end of the muzzle adapter 1. Reduced area domed openings 5*c* communicate between the recesses 5*a* and the second portion 13*b* of the muzzle adapter bore 13. In each of the recesses 5*a*, there is disposed a retaining ball 5*d* urged, by an elastomeric retaining band 5*e*, toward the base of the respective recess 5*a*, whereat a portion of the ball 5*d* projects through the opening 5*c* and into the muzzle adapter bore 13, pressing against a fastener 7 which is thereby retained in the muzzle adapter bore 13.

The shroud 9 comprises a cup-shaped first shroud member 9*a*, abuttable against the tool receiver 17 and loosely overlying the portion of the tool barrel 11 projecting therefrom, and a cylindrical second shroud member 9*b*, loosely telescoped over the bulk of the muzzle adapter 1 and captured between the first shroud member 9*a* and snap-ring 9*c* adjacent the muzzle end of the adapter 1. As seen, the shroud 9 prevents the tool user from directly grasping the muzzle adapter 1 or the projecting portion of the tool barrel 11. The only way in which the barrel 11 may be displaced into the receiver 17 is by pressing the adapter 1 against the workpiece 19.

"Air firing" of the tool, i.e. firing a fastener into the air, is thus prevented.

Various changes in details and arrangement of parts can be made by one skilled in the art without departing from the spirit of the invention which is limited in scope only by the appended claims.

I claim;

1. In a powder-actuated tool of the type including a receiver, a barrel telescopically mounted in said receiver and having a bore, and a first piston operatively disposed within said barrel bore; the improvement comprising a muzzle adapter carried on the muzzle end of said barrel and having a bore concentric with said barrel bore, a second piston operatively disposed in said muzzle adapter bore in co-operative relation to said first piston, and retention means on said muzzle adapter for retaining a fastener within said muzzle adapter bore prior to driving thereof, said muzzle adapter bore comprising a first portion, adjacent said barrel, of a size to slidingly admit the shank of said first piston, and a second portion, in the distal end of said muzzle adapter, of a size to slidingly admit a fastener to be driven and of substantially smaller diameter than said first portion; and said second piston comprises a piston head, slidingly fitted in said first portion of said muzzle adapter bore, and a piston shank, slidingly fitted in said second portion thereof, whereby relatively small-diameter washered and non-washered fasteners may be reliably driven into hard receiving materials.

2. The tool of claim 1, wherein said retention means comprises a plurality of retaining members, each of said retaining members being displaceable to a position whereat a portion thereof projects into said second portion of said muzzle adapter bore, and means urging said retaining members toward said projecting positions.

3. The tool of claim 1, further comprising a tubular, resilient buffer member disposed in said first portion of said muzzle adapter bore, adjacent said second portion of said bore, with said shank of said second piston passing therethrough.

4. The tool of claim 1, wherein both of said pistons are displaceable between driving and driven positions, said pistons, in said driving positions, being spaced apart approximately $\frac{1}{4}$ inch, whereby tool recoil is minimized.

5. The tool of claim 1, further comprising shroud means surrounding the bulk of said muzzle adapter and denying substantial manual contact therewith, said muzzle adapter being moveable relative to said shroud means.

6. A driver assembly, for use with a powder-actuated tool having a tool piston, comprising a tubular muzzle adpter adapted to be carried by the muzzle end of the barrel of the tool, an adapter piston operatively disposed in said muzzle adapter, and retention means on said muzzle adapter for retaining a fastener therein prior to driving thereof, said muzzle adapter being formed with an axial through bore, said bore comprising first and second portions, said first portion being adapted to slidingly admit the shank of the tool piston, said second portion being of substantially smaller diameter than said first portion, and said adapter piston comprising an adapter piston head, skidingly fitted in said first portion of said muzzle adapter bore, and an adapter piston shank, slidingly fitted in said second portion thereof.

7. The assembly of claim 6, wherein said retention means comprises a plurality of retaining members, each of said retaining members being displaceable to a position whereat a portion thereof projects into said second portion of said muzzle adapter bore, and means urging said retaining members toward said projecting positions.

8. The assembly of claim 6, further comprising a tubular, resilient buffer member disposed in said first portion of said muzzle adapter bore, adjacent said second portion of said bore, with said piston shank passing therethrough.

9. The assembly of claim 6, further comprising shroud means surrounding the bulk of said muzzle adapter and denying substantial manual contact therewith, said muzzle adapter being moveable relative to said shroud means.

* * * * *